US005203383A

United States Patent [19]

Turunen

[11] Patent Number: 5,203,383

[45] Date of Patent: Apr. 20, 1993

[54] SYSTEM FOR USING AEROSOLS AND AEROSOL PACKAGES

[76] Inventor: Pentti Turunen, Vähänummentie 5, SF-04440 Järvenpää, Finland

[21] Appl. No.: 677,664

[22] Filed: Mar. 29, 1991

[30] Foreign Application Priority Data

Jan. 15, 1991 [FI] Finland ..... 910201

[51] Int. Cl.[5] ..... B65B 3/04

[52] U.S. Cl. ..... 141/20; 141/3

[58] Field of Search ..... 141/3, 20

[56] References Cited

U.S. PATENT DOCUMENTS

| | | | |
|---|---|---|---|
| 3,174,519 | 3/1965 | Pizzurro et al. | 141/353 X |
| 3,211,191 | 10/1965 | Honisch | 141/20 |
| 3,237,659 | 3/1966 | Albrecht | 141/20 |
| 3,335,765 | 8/1967 | Moonan | 141/20 |
| 3,451,592 | 6/1969 | Bartels | 141/20 |
| 3,572,402 | 3/1971 | Beffel | 141/20 X |
| 3,710,538 | 1/1973 | Lowy et al. | 141/3 X |
| 3,765,459 | 10/1973 | Morse | 141/20 |
| 3,797,534 | 3/1974 | Skidmore | 141/3 |
| 4,285,372 | 8/1981 | Kieber | 141/2 |
| 4,917,156 | 4/1990 | Varlet | 141/20 |
| 4,920,020 | 5/1990 | Pamper | 141/20 |
| 4,938,260 | 7/1990 | Hirz | 141/20 |

FOREIGN PATENT DOCUMENTS

| | | | |
|---|---|---|---|
| 3307245 | 9/1984 | Fed. Rep. of Germany | 141/20 |
| 2402582 | 5/1979 | France | 141/20 |
| 319896 | 3/1957 | Switzerland | 141/20 |

*Primary Examiner*—Ernest G. Cusick

*Attorney, Agent, or Firm*—Andrus, Sceales, Starke & Sawall

[57] ABSTRACT

An apparatus for filling aerosol packages. The aerosol package includes an outer pressure resistant shell having an opening in the upper end and a resilient container is disposed within the shell as an inlet sealed within the opening of the shell. A valve unit is disposed in the opening and includes a valve. A propellant gas is located in the space between the shell and the container. The filling apparatus includes a reservoir of liquid and a nozzle communicates with the reservoir. The nozzle is inserted in the valve unit and acts to open the valve and a force is then applied to the liquid in the reservoir to transfer the liquid from the reservoir to the container within the aerosol package.

3 Claims, 2 Drawing Sheets

SYSTEM FOR USING AEROSOLS AND AEROSOL PACKAGES

BACKGROUND OF THE INVENTION

The present invention concerns a system for using various aerosols and aerosol packages.

The use of aerosol packages is nowadays extremely widespread, in various applications. It is common to package in aerosol packages: detergents, protectants, parting agents, therapeutic agents and equivalent employed in various fields. For instance, paints, varnishes, plant protectants, various poisons, fats and other lubricants, and on the whole all kinds of chemical compounds which are not normally encountered in nature.

These substances, and their packages, give rise to many kinds of problems. The packages themselves, consisting of plastic or tinplate, produce large quantities of refuse which cannot be economically utilized by burning or recycling. The propellant gas used in the packages has up to date mostly been harmful to nature, but this is largely being eliminated already. It is also a fact that on exhaustion of the package there is always left in it a certain amount of the substance which it held and which also pollutes the environment in case the package is broken. Moreover, the packages that are used are comparatively heavy, bulky and expensive; the cost of the package constitutes a great part, or even the greatest part, of the product's price.

SUMMARY OF THE INVENTION

The object of the invention is to eliminate these drawbacks. It is a particular object of the invention to create a novel system for using pressurized aerosol packages which enables the pressurized packages to be reused and which prevents various wastes and pollutants from ending up in the environment.

As taught by the invention, the system for using aerosols and aerosol packages comprises a plurality of reusable aerosol packages which consist of a pressure-resistant, preferably cylindrical shell having a bottom, and of a resilient container changing form in accordance with prevailing pressure and placed within said shell, this container being sealed to the rim of an aperture in the cover of the shell with a plug which comprises a press valve, known in itself in the art, such as is used on aerosol packages. The resilient container defines in the interior space of the aerosol package two spaces hermetically sealed against each other, the interior space of the resilient container being intended for a liquid having suitable viscosity, while the space between the resilient container and the shell of the package is meant for the propellant gas that will be used. Moreover, the system includes an aerosol package filling apparatus consisting of at least one, but advantageously several, liquid containers containing a larger quantity of the liquid that will be used in the aerosol packages, as well as a nozzle and a force means with the aid of which the valve of the aerosol package can be opened and the desired liquid can be pushed into the volume defined by the resilient container, overcoming the pressure caused by the propellant gas.

The resilient container to be used consists of a jacket, impermeable to liquid and gas, advantageously of suitable plastic, rubber or equivalent material. For propellant gas, virtually any gas nay be used, but advantageous propellant gases are: nitrogen, air, and carbon dioxide.

Advantageously, the shell — for instance the bottom thereof — comprises a suitable hole which can be tightly closed with a plug so that through this hole the space between the resilient container and the shell of the package can be filled with propellant gas under appropriate pressure.

The aerosol package filling apparatus advantageously comprises a plurality of liquid containers with a capacity which is large compared with the capacity of the aerosol packages to be filled, these containers containing various liquids, among which in each instance the desired liquid can be chosen when an aerosol package is being filled.

The force means on the filling apparatus may be a manually operated lever connected to a suitable, pumping piston. It is however equally possible to use for power means various suitable hydraulic, pneumatic or electric arrangements by which the liquid can be made to discharge under adequate pressure through a nozzle and through the press valve on the aerosol package, into the package.

The advantage of the invention over prior art is that

- the propellant gases that are employed cannot escape from the package and are instead retained in their hermetic condition from one period of use to another, operating with equal efficiency at all times;
- the waste disposal problems associated with empty pressurized packages are abolished because one package can be used over and over again, simply by refilling it;
- the need of storage and transporting is significantly reduced because no packages need be transported and stored, merely those liquids which will be used, in larger containers;
- all environment pollution due to small substance quantities left in empty packages will stop because the packages are not thrown away with refuse: they are reused over and over again;
- the pressurized packages are easy to use because they operate perfectly in any position; and
- aerosol use becomes appreciably less expensive because the costs arising from package and waste handling are eliminated.

DESCRIPTION OF THE DRAWINGS

In the following the invention is described in detail, referring to the attached drawing, wherein.

DESCRIPTION OF THE ILLUSTRATED EMBODIMENT

Figure 1:
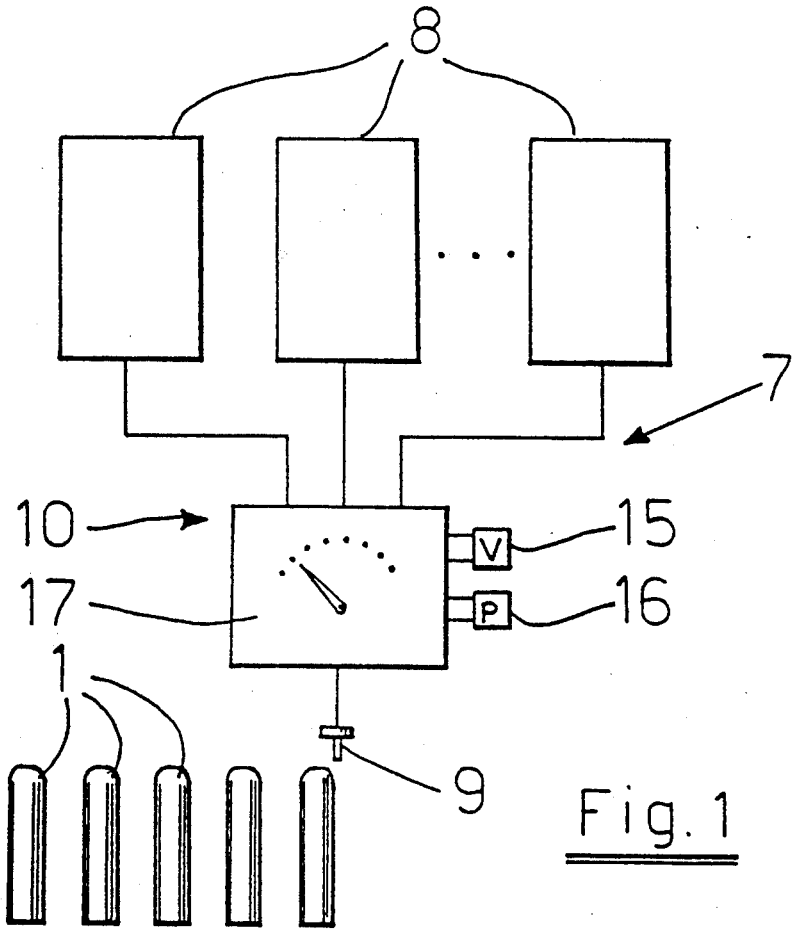
FIG. 1 presents the block diagram of a filling apparatus according to the invention.

In FIG. 1 is schematically depicted a system according to the invention, comprising a number of liquid containers 8, from which the liquids are enabled to flow to a force means 10, such as a suitable pump. In conjunction with the force means is provided a suitable control means 17, by which that particular liquid container is selected from which liquid shall be drawn. The force means furthermore includes volume measuring members 15 and pressure measuring members 16, by which the quantity of liquid pumped and the pressure in the aerosol package 1 are measured. The aerosol packages 1 are filled by removing the press buttons or plungers 21 of valve units 25 and a nozzle 9 is pushed through the hole in the valve unit to open the press valve. The appropriate amount of liquid from the selected liquid container 8 is then pressed into the package 1 with the force means 10.

Figure 2:
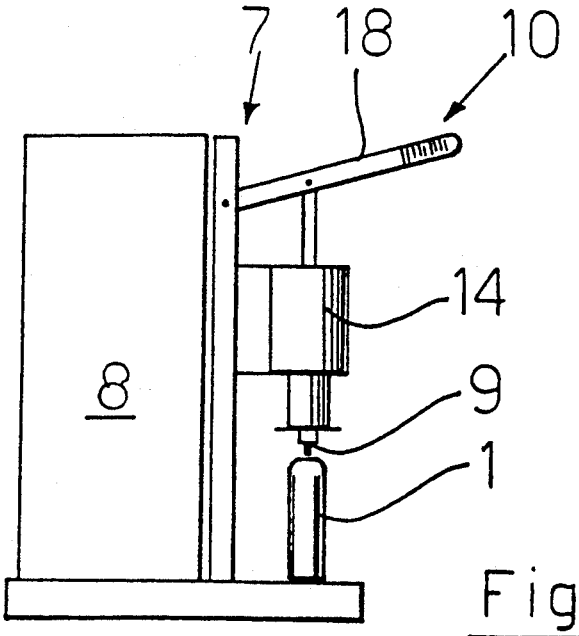
FIG. 2 presents the principle drawing of a filling apparatus according to the invention.
Figure 4:
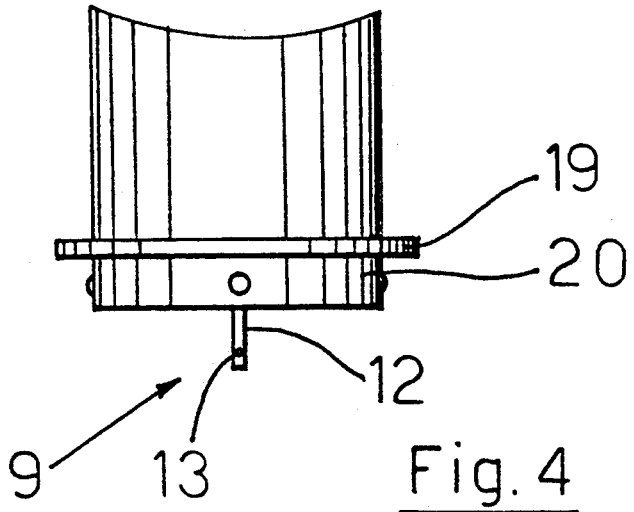
FIG. 4 shows a detail of FIG. 2.

FIG. 2 displays, in greater detail, a simple. manual filling apparatus 7 for aerosol packages 1. This is composed of a liquid container 8 and a force means 10 communicating therewith, this force means consisting of a piston 14 and a lever 18 resting on the piston rod. On the lower end of the piston and of the cylinder surrounding it, a nozzle 9 is provided, consisting (FIG. 4) of a backing plate 19, a valve attachment 20 under this backing plate and centrally below this, a tube 12 with closed end, presenting a transverse hole 13.

The apparatus of FIG. 2 is operated as follows. An empty aerosol package 1, from which the press button or plunger 21 of the press valve has been removed, is placed under the piston 14 and nozzle 9 and the valve attachment 20 is pressed against the valve unit 25 of the package in such manner that the tube 12 is pressed into the hole of the valve unit, opening the valve. The lever 18 is then operated to pump, with the piston 14, the appropriate liquid quantity into the package 1. The force applied to the liquid through operation of lever 18 exceeds the pressure of the propellant gas in the shell 2, so that the liquid will flow through the nozzle 9 and valve unit 25 to the resilient container 3. It is possible in a manually operated apparatus like this, to adjust the proper quantity merely by using a lever arm 18 of appropriate length, but the proper degree of filling may equally be determined by measuring the pressure, or the liquid volume.

Figure 3:
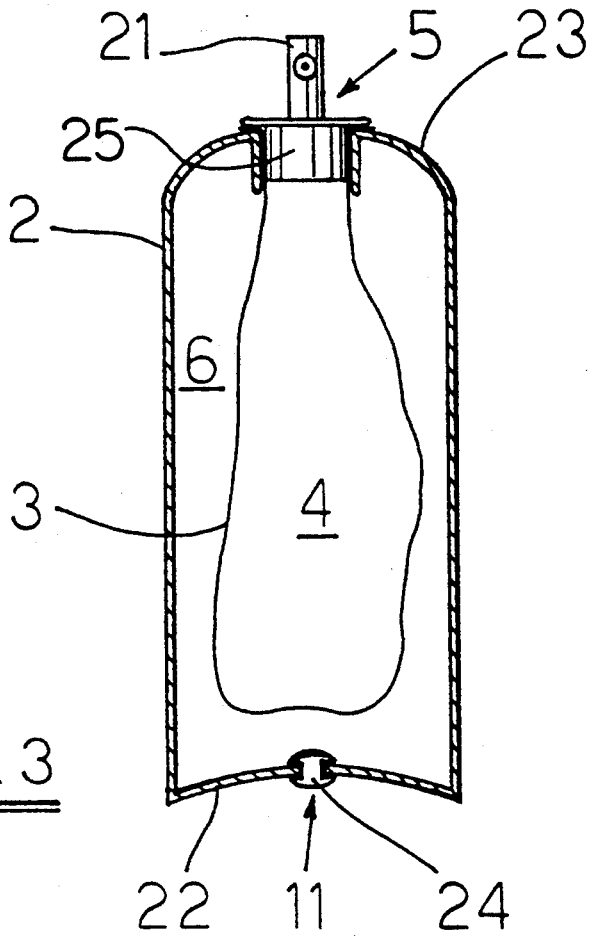
FIG. 3 presents, partly sectioned, the elevational view of an aerosol package according to the invention.

In FIG. 3 is depicted a suitable aerosol package for use in the system of the invention. This package consists of a cylindrical shell 2 with concave bottom 22 and convex top 23. The bottom presents a hole 11, closed with a plug 24. The top 23 presents a larger aperture, closed with the press valve 5 so that the margins of the bag-like resilient container 3 are sealed between the aperture and the press valve. Hereby two hermetically separated volumes are established in the interior space defined by the package 1: the volume 4 confined by the container 3, and the space 6 between the container and the shell.

When the package 1 is being manufactured, and before the plug 24 is put in place, suitable propellant gas, e.g. nitrogen, is introduced through the hole 11 in the volume 6. This gas will squeeze the container 3 flat, in the center of the aerosol package 1. When filling the aerosol package, one has to remove the press button 21 and to press through the valve hole the desired liquid into the bag-like space 4 defined by the container 3, whereby this space expands and substantially fills the greater part of the interior of shell 2, as the propellant gas is more strongly compressed between shell and container. When the package is in use, the propellant gas will press the container 3 back to slender shape, but it is to be noted that at no stage in the use of the package can any propellant gas escape through the press valve 5, nor is it at any stage in direct contact with the liquid in the container. Therefore, in the system of the invention the container is refillable and reusable over and over again.

In the foregoing the invention has been described by way of example with the aid of the attached drawings, while different embodiments of the invention are feasible within the scope of the inventive idea delimited by the claims.

I claim:

1. In combination, an aerosol package having an outer pressure resistant shell, said shell having an opening therein, a resilient container disposed within the shell and having an inlet sealed within said opening, a valve disposed in said opening, a propellant gas disposed in the space between the shell and the container, a filling apparatus for introducing a liquid into the container, said filling apparatus including a reservoir of liquid and a nozzle communicating with said reservoir and disposed to be inserted in said valve to open said valve, and force means for applying a force to said liquid in the reservoir to thereby transfer the liquid from the reservoir through said nozzle to said container.

2. The combination of claim 1, wherein said nozzle includes a straight closed-end tube having a transverse hole through which liquid is discharged into said container.

3. The combination of claim 1, wherein said force means is constructed and arranged to exert a force on the liquid in excess of the pressure of the propellant gas in said space, so that the liquid will flow through the nozzle and valve into said container.

* * * * *